US007614937B2

(12) United States Patent
Nydegger

(10) Patent No.: US 7,614,937 B2
(45) Date of Patent: Nov. 10, 2009

(54) CUTTING DEVICE AND METHOD OF GENERATING CUTTING GEOMETRY

(75) Inventor: Daniel L. Nydegger, Auburn, WA (US)

(73) Assignee: The Boeing Company, Chicago, IL (US)

( * ) Notice: Subject to any disclaimer, the term of this patent is extended or adjusted under 35 U.S.C. 154(b) by 339 days.

(21) Appl. No.: 10/809,698

(22) Filed: Mar. 26, 2004

(65) Prior Publication Data

US 2005/0211043 A1 Sep. 29, 2005

(51) Int. Cl.
*B26B 9/00* (2006.01)

(52) U.S. Cl. ..... 451/45; 451/910; 30/346.55; 30/353; 30/356

(58) Field of Classification Search ..... 451/45, 451/910; 30/346, 346.5, 346.55, 346.57, 30/353, 356, 346.53, 346.54, 350
See application file for complete search history.

(56) References Cited

U.S. PATENT DOCUMENTS 4,867,834 A 9/1989 Alenskis et al.
5,217,477 A * 6/1993 Lager ..... 606/167
5,258,002 A * 11/1993 Jeffers et al. ..... 606/167
5,935,143 A * 8/1999 Hood ..... 606/169
6,436,115 B1 * 8/2002 Beaupre ..... 606/169
2002/0156493 A1 * 10/2002 Houser et al. ..... 606/169
2003/1020419 * 10/2003 Novak et al. ..... 606/169
2004/0232669 A1 * 11/2004 Leland et al. ..... 280/732

* cited by examiner

*Primary Examiner*—Jacob K Ackun, Jr.

(57) ABSTRACT

An ultrasonic blade includes a blade body and a cutting edge. The blade body is defined about a generally axial line. The cutting edge is on the blade body and is defined by the intersection of a first surface and a second surface. The first surface includes a first incident angle of about 0° to 35° from the axial line and a first curve of about 10° to 20° formed at the first incident angle. The second surface includes a second incident angle of about 0° to −35° from the axial line and a second curve of about 10° to 20° formed at the second incident angle.

18 Claims, 4 Drawing Sheets

78

CUTTING DEVICE AND METHOD OF GENERATING CUTTING GEOMETRY

FIELD OF THE INVENTION

The present invention generally relates to cutting devices and methods of generating cutter geometry. More particularly, the present invention pertains to a cutting blade, a device to generate an edge of the cutting blade, and a method of generating the edge.

BACKGROUND OF THE INVENTION

When cutting a variety of sheet materials such as carbon fiber, various other fibers, metal foils and composites, an edged cutting tool is generally utilized. In the case of particularly tough and/or abrasive sheet materials, the useful life of the edge of the cutting tool may be relatively short. To overcome this relatively short useful life of edged tools a variety of conventional cutting devices have been utilized. For example, high speed cutting discs are conventionally used to cut such sheet materials. However, high speed cutting discs generate dust that may negatively effect composite layups. Another conventional method of cutting relatively difficult sheet materials is to utilize standard edged cutting tools and replace these cutting tools at a greater frequency.

A disadvantage associated with utilizing conventional edged cutting tools or cutters is that production is generally stopped while the cutter is being replaced. Thus, as the frequency of replacement increases, down time also increases. Another disadvantage associated with cutting certain relatively tough materials such as titanium foil and titanium graphite composites is that the edge of the cutter may chip. Chipped cutters generally do not cut and may drag material. Materials so dragged may be unusable and thus further increase delays and expense.

Accordingly, it is desirable to provide a cutting tool, an apparatus to generate an edge, and a method of generating the edge capable of overcoming the disadvantages described herein at least to some extent.

SUMMARY

The foregoing needs are met, to a great extent, by the present invention, wherein in some embodiments a cutting tool, an apparatus to generate an edge, and a method of generating the edge is provided.

An embodiment of the present invention pertains to an ultrasonic blade. The ultrasonic blade includes a blade body and a cutting edge. The blade body is defined about a generally axial line. The cutting edge is on the blade body and is defined by the intersection of a first surface and a second surface. The first surface includes a first incident angle of about 0° to 35° from the axial line and a first curve of about 10° to 20° formed at the first incident angle. The second surface includes a second incident angle of about 0° to −35° from the axial line and a second curve of about 10° to 20° formed at the second incident angle.

Another embodiment of the present invention relates to a device to generate a profile for a cutting tool. The device includes a base and a chuck. The base includes a top surface. The chuck includes a bore to detachably secure the cutting tool, a first angled surface to mate with the top surface, and a second angled surface to mate with the top surface. Mating the first angled surface and the top surface disposes the cutting tool at a first incident angle. Mating the second angled surface and the top surface disposes the cutting tool at a second incident angle. In addition, the chuck is rotatably secured to the base.

Yet another embodiment of the present invention pertains to a device for generating a profile of an ultrasonic blade. The device includes a means for introducing a first side of a blade body to an abrasive surface at a first incident angle. The blade body is defined about a generally axial line. The first incident angle is 0° to 35° from the axial line. In addition, the device includes a means for rotating the blade body relative to the abrasive surface and at the first incident angle. The rotation is about 10° to 20°. The device further includes a means for withdrawing the blade body from the abrasive surface and a means for introducing a second side of the blade body to the abrasive surface at a second incident angle. The second incident angle is 0° to 35° from the axial line. The device further includes a means for rotating the blade body relative to the abrasive surface and at the second incident angle. The rotation is about 10° to 20°.

Yet another embodiment of the present invention relates to a method of generating a profile of an ultrasonic blade. In this method, a first side of a blade body is introduced to an abrasive surface at a first incident angle. The blade body is defined about a generally axial line and the first incident angle is 0° to 35° from this axial line. In addition, the blade body is rotated relative to the abrasive surface and at the first incident angle. This rotation is about 10° to 20°. Furthermore, the blade body is withdrawn from the abrasive surface and a second side of the blade body is introduced to the abrasive surface at a second incident angle. The second incident angle is 0° to 35° from the axial line. Moreover, the blade body is rotated relative to the abrasive surface and at the second incident angle. This rotation is about 10° to 20°.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

The present invention provides, in some embodiments, an ultrasonic cutting tool, a device to generate a profile for the ultrasonic cutting tool and method for generating the profile. In an embodiment, the invention provides for an ultrasonic cutting tool for cutting a variety of suitable materials. Examples of suitable materials generally include sheet materials such as fiber mat, fiber tape, composite material, metal foil, and the like. More particularly, suitable materials include titanium graphite composites, titanium foil, graphite composite prepreg, and the like. This ultrasonic cutting tool or stylus is typically disposed upon an ultrasonic transducer. The ultrasonic transducer generates vibrational energy that induces vibration of the stylus. The frequency of this vibration is generally based upon the mass of the stylus, a stylus base if present, the material being cut, and the like. As such, depending upon the particular system, the vibrational energy generated may range from a few Hertz (Hz) to 100 Mega Hz (MHz) or more.

In another embodiment, the invention provides a device to generate the profile of the ultrasonic cutting tool. The device includes a base and a chuck. The base include a top surface on to which the chuck is mounted. The chuck includes a bore to detachably secure the cutting tool, a first angled surface to mate with the top surface, and a second angled surface to mate with the top surface. Mating the first angled surface and the top surface disposes the cutting tool at a first incident angle. Mating the second angled surface and the top surface disposes the cutting tool at a second incident angle. In addition, the chuck is rotatably secured to the base. In an embodiment of the invention, the first angled surface is mated to the base and an abrasive surface is introduced to the cutting tool. By introducing the abrasive surface parallel to an axis of rotation of the chuck, one surface of the cutting tool is generated. This surface is further defined by rotating the chuck and thus, generating a camber in the surface of the cutter. To generate the other surface of the cutting tool, the second angled surface of the chuck is mounted to the base, the cutting tool is re-introduced to the abrasive surface, and the chuck is rotated.

Figure 2:
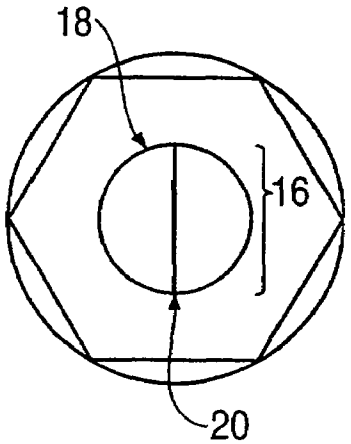
FIG. 2 is a front view of the ultrasonic cutting tool according to FIG. 1.
Figure 1:
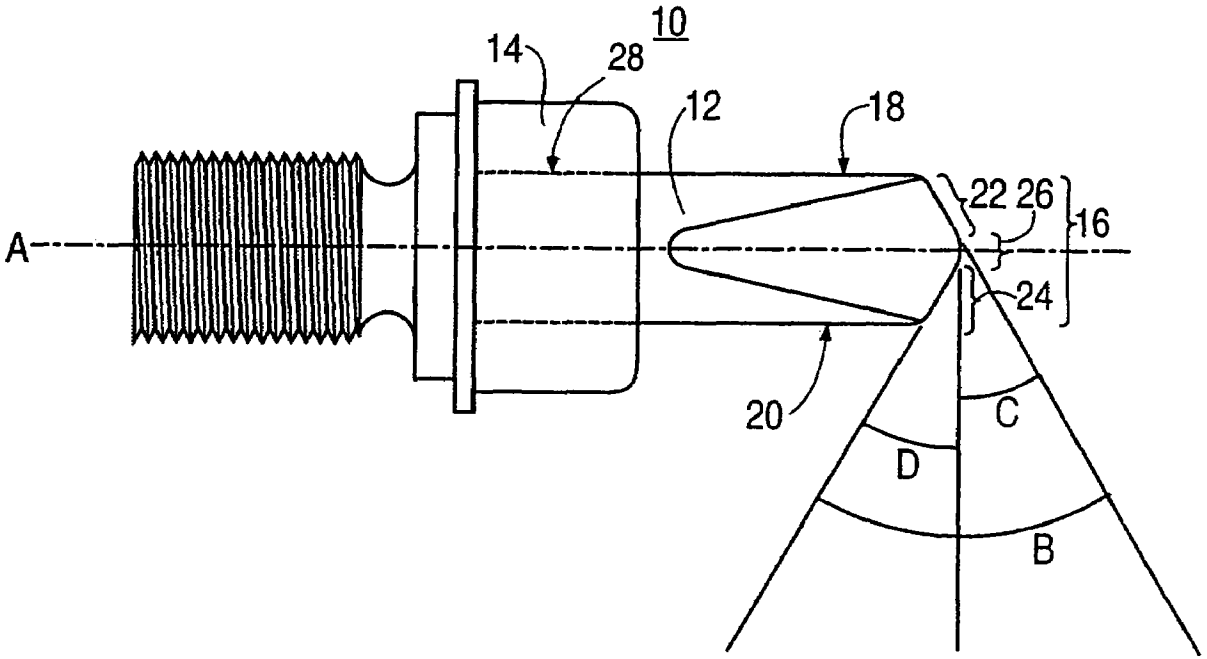
FIG. 1 is a side view of an ultrasonic cutting tool according to an embodiment of the invention.

The invention will now be described with reference to the drawing figures, in which like reference numerals refer to like parts throughout. As shown in FIGS. 1-4 an ultrasonic cutting tool (cutter) 10 includes a stylus 12 and a cutter base 14. The stylus 12 includes an edge 16 and an axial line A. The edge 16 forms a substantially continuous profile spanning the distance from a side 18 of the stylus 12 to a side 20 of the stylus 12. That is, there are essentially no facets in the edge 16. In an embodiment of the invention, the edge 16 includes a plurality of substantially straight portions 22 and 24 and a curved portion 26. As shown in FIG. 1, the straight portions 22 and 24 are at an angle B relative to one another. Also shown in FIG. 1, the straight portion 22 is at an angle C relative to a line perpendicular to the axial line A and the straight portion 24 is at an angle D relative to a line perpendicular to the axial line A. In a substantially smooth manner, the curved portion 26 transitions the edge 16 from the angle of the straight portion 22 to the angle of the straight portion 24. In a particular embodiment the angle B is 60°, the angles C and D are 30°, and the curved portion 26 has a radius of 0.04 inches. However, in various other embodiments, the angles B, C, D, and/or the curved portion 26 may be different. In general, the angles B, C, D, and the curved portion 26 are based upon a variety of factors. These factors include: the material composition and/or temperature profile (heat/cold treatment) of the stylus 12; characteristics of material to be cut; frequency of an ultrasonic transducer; system setup; optimization of the system; and the like.

The cutter base 14 includes a bore 28 and a shank 30. The bore 28 mates with the stylus 12 in any suitable manner. For example, the stylus 12 may be press fit, threaded, secured with a set screw, or the like. The shank 30 mates with an ultrasonic transducer or similar device. As such, the configuration of the shank is dependent upon the configuration of the ultrasonic transducer utilized.

Figure 4:
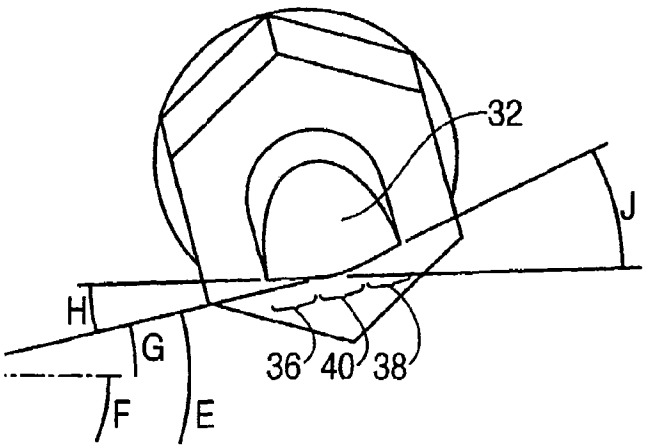
FIG. 4 is a perspective view of the ultrasonic cutting tool according to FIG. 1.
Figure 3:
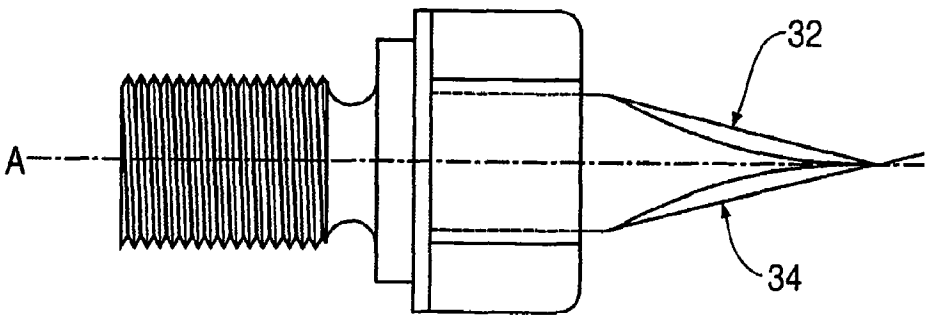
FIG. 3 is another side view of the ultrasonic cutting tool according to FIG. 1.

As shown in FIG. 3, the edge 16 is generated by the intersection of two surfaces 32 and 34. These surfaces 32 and 34 are at an angle E relative to one another and at respective angles F and G relative to the axial line A. In addition, the surfaces 32 and 34 are curved or cambered. This curvature in combination with the angles F and G are configured in a manner so as to generate the profile of the edge 16 as described herein. The curvature of the surface 32 is illustrated in FIG. 4. According to an embodiment, when viewed edge-on, the surface 32 includes a plurality of substantially straight portions 36 and 38 and a curved portion 40. The straight portions 36 and 38 are at respective angles H and J relative to a line tangent to the curved portion 40. In a substantially smooth manner, the curved portion 40 transitions the surface 32 from the angle H to the angle J. In a particular embodiment the angle H is 7.2°, the angle J is 7.2°, and the curved portion 40 is at a radius of 0.171 inches. However, in various other embodiments, the angles H and/or J, and/or the curved portion 40 may be different. In general, the angles H and J are configured to generate the angles B, C, and D thus, based the those factors discussed herein with reference to the angles B, C, and D, the angle H and J are configured accordingly. Also, the curved portion 40 is configured to generate the curved portion 26 and thus, based the those factors discussed herein with reference to the curved portion 26, the curved portion 40 is configured accordingly.

Figure 5:
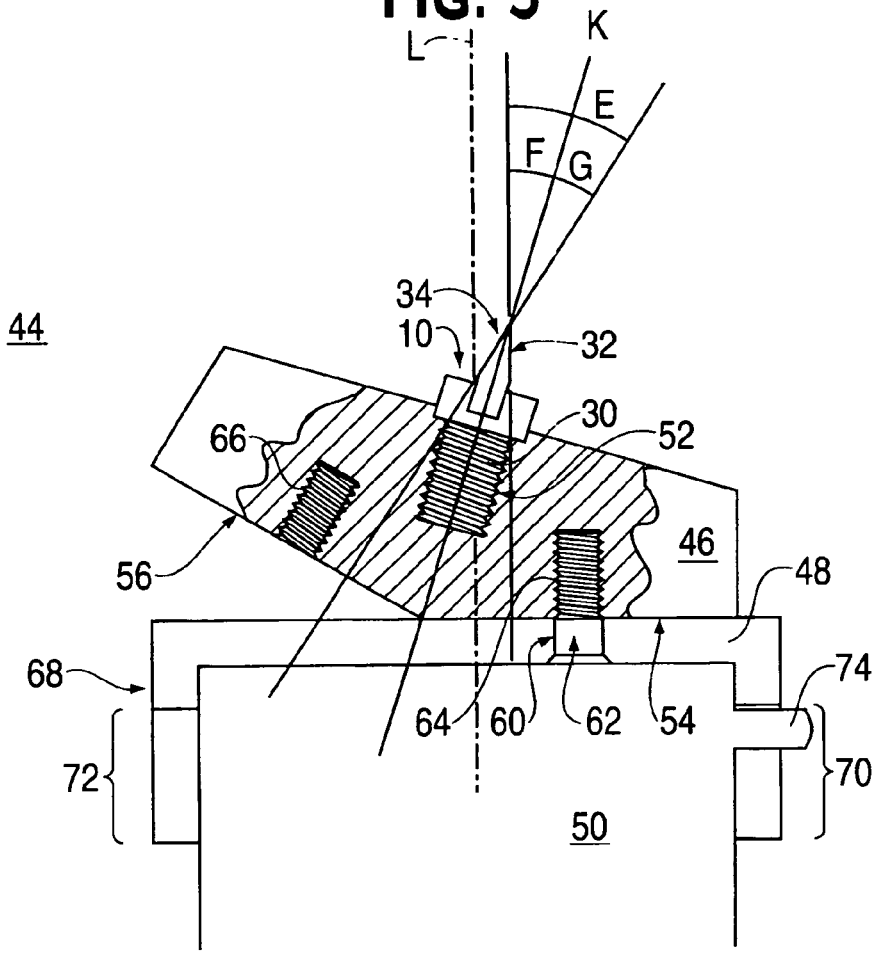
FIG. 5 is a cut away view of a chuck device according to an embodiment of the invention.

FIG. 5 is a cross sectional view of a device 44 to generate the edge 16 on the cutter 10. It is to be noted, however, that while the device 44 is illustrated generating the edge 16 in FIG. 5, embodiments of the invention are not limited to generating the edge 16 with the device 44 but rather, any suitable manner of generating the edge 16 is within the scope of the invention. In particular, according to another embodiment of the invention, a numerically controlled (NC) milling machine is instructed to generate the edge 16. Thus, the device 44 shown in FIG. 5 is for illustrative purposes only. To continue, as shown in FIG. 5, the device 44 includes a chuck 46, an indexing plate 48, and a chuck base 50. The chuck 46 is configured to detachably secure the cutter 10. For example, in an embodiment of the invention, the chuck 46 includes a threaded bore 52 to mate with the threaded shank 30. The bore 52 includes an axial line K. The chuck 46 further includes a plurality of surfaces 54 and 56. To generate the various angles of the cutter 10, the surfaces 54 and 56 are angled with respect to the axial line K. In particular, the surface 54 is angled with respect to the axial line K to generate the angle F and the surface 56 is angled with respect to the axial line K to generates the angle G.

The chuck 46 is secured to the indexing plate by any suitable fastening device. For example, as shown in FIG. 5, the indexing plate 48 includes a hole 60, through which a bolt 62 is threaded into a threaded bore 64. In this manner, the surface 54 is mounted to the indexing plate 48. In addition, to mount the surface 56 to the indexing plate 48, the bolt 62 is threaded into a threaded bore 66. Furthermore, although one bolt 62 is shown, in various embodiments of the invention, two or more bolts are utilized to secure the chuck 46 to the indexing plate 48.

Figure 6:
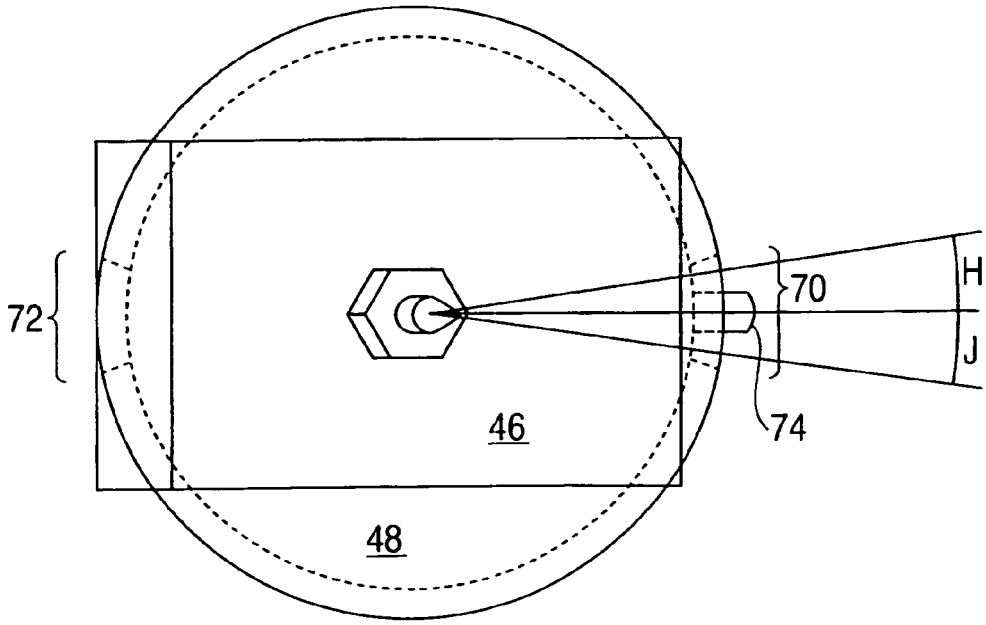
FIG. 6 is top view of the chuck device shown in FIG. 5.

To pivotally secure the chuck 46 and indexing plate 48 assembly to the chuck base 50, the indexing plate 48 includes a rim 68. The rim 68 is configured to engage the chuck base 50 and rotate about the chuck base 50 with a minimal amount of lateral play. The indexing plate 48 rotates upon the chuck base 50 about an axial line L. To modulate the degree to which the chuck 46 may rotate relative to the chuck base 50, the rim 68 includes a plurality of slots 70 and 72. These slots 70 and 72 are configured to engage and indexing pin 74. As shown in FIG. 6, the slots 70 and 72 are configured to allow sufficient movement of the indexing pin 74 so as to generate the angles H and J.

As shown in FIG. 5, the axial line L is set back from the surface 32 sufficiently so as to generate the curved portion 40. In a particular example, the axial line L is offset 0.171 inches from the surface 32 so as to generate a corresponding radius upon the curved portion 40.

FIG. 6 is a top view of the chuck base 50 according to the FIG. 5. As shown in FIG. 6, the slot 70 and indexing pin 74 are configured to allow sufficient rotation of the chuck 46 relative to the chuck base 50 so as to generate the angles H and J.

Figure 7:
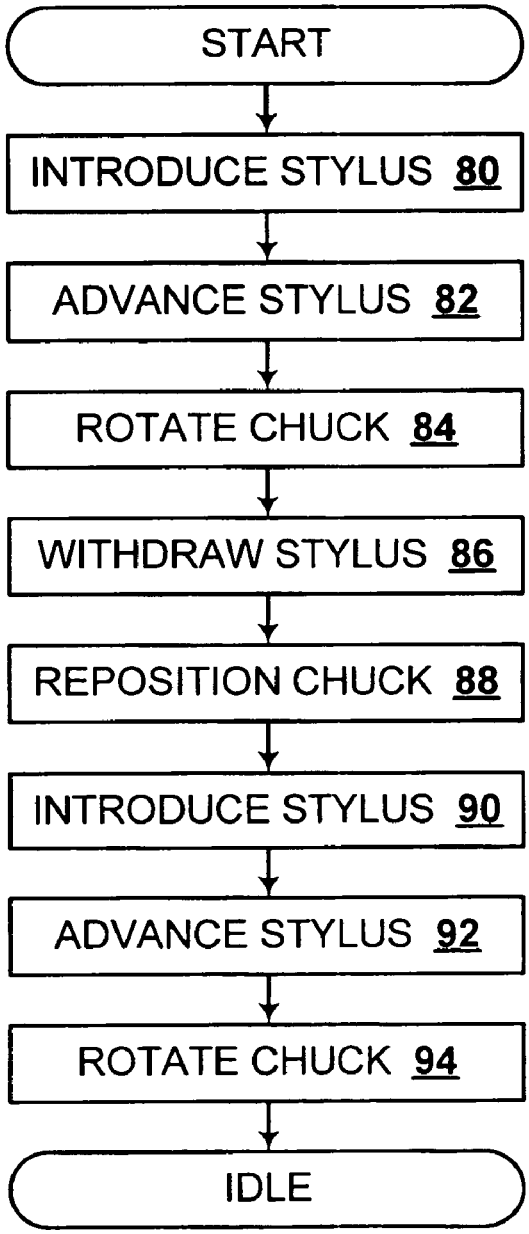
FIG. 7 is a flow diagram according to an embodiment of the invention.

FIG. 7 is a flow diagram of a method 78 according to an embodiment of the invention. In the method 78, a device such as the device 44 is utilized to generate the edge 16 upon the stylus 12. Prior to initiation of the method 78 a variety of tasks may be performed. These tasks include, in no particular order: secure a stylus blank within the chuck 46; mount the chuck 46 to the index plate 48; mount the index plate 48 to the chuck base 50; power the grinder; and the like. In a particular example, the surface 54 is mounted to the index plate 48.

As shown in FIG. 7, the method 78 may be initiated at step 80 by introducing the stylus blank to a grinding surface. The stylus blank is essentially a stylus such as the stylus 12 that lacks a fully formed edge such as the edge 16. The grinding surface includes any suitable abrasive, milling, ablative, or other such surface that is operable to remove material from the stylus 12. This grinding surface is positioned parallel to the axial line L and at a height sufficient to engage the stylus 12.

At step 82 the stylus 12 is advanced relative to the grinding surface. In general, the speed at which the stylus is advanced is dependent upon the rate at which material is removed from the stylus 12. This material removal rate is varies according to the material characteristics of the stylus 12, grit composition and condition of the abrasive, rotational speed of the grinding surface, and the like. In addition, the stylus 12 is advanced until a sufficient amount of material is removed. In general, the amount of material removal is dependent upon the profile of the edge 16 and various finishing steps that are optionally performed. For example, if the edge 16 is to bisect the axial line A, the stylus 12 is advanced until surface 32 intersects the axial line A. However, if a polishing step is to be performed, the advance of the stylus 12 may be stopped just prior to the surface 32 intersecting the axial line A. In this regard, the generation of the surfaces 32 and/or 34 need not be performed in a single step or pass. Instead, two or more passes may be performed. For example, the surface 32 is roughly formed in a first pass and then finish formed in a second pass. Furthermore, if the stylus 12 includes excess length, the stylus 12 is advanced past the point that the surface 32 intersects the axial line A. Upon removal of sufficient material from the stylus 12, the stylus 12 is rotated at step 84.

At step 84 the stylus 12 is rotated to generate the curvature or camber in the surface 32. For example, the indexing plate 48 and thus the stylus 12, is rotated such that the indexing pin 74 contacts one side of the slot 70 and then the other side of the slot 70. In addition, the steps 82 and 84 need not be performed in the order presented but rather, the steps 82 and 84 may be performed essentially simultaneously, alternating one then the other, or the like.

At steps 86 and 88 the stylus 12 is withdrawn from the grinding surface and the chuck 46 is repositioned upon the indexing plate 48. For example, fasteners securing the chuck 46 are removed, the surface 56 is mated to the indexing plate 48, and the fasteners re-secured. In addition, the grinding surface is optionally de-powered as a safety precaution and/or to prepare the grinding surface for subsequent milling operations. The repositioned chuck and indexing plate assembly is re-mounted upon the chuck base 50 and, at step 90, re-introduced to the grinding surface.

At step 90 the stylus 12 is re-introduced to the grinding surface. The step 90 is similar to the step 80. Thus, the device 44 is positioned relative to the grinding surface and, if de-powered, the grinding surface is powered or otherwise prepared to mill the stylus 12.

At step 92 the stylus 12 is advanced relative to the grinding surface. The steps 92 and 94 are similar to the steps 82 and 84. In this regard, the stylus 12 is advanced until a sufficient amount of material is removed. In general, the amount of material removal is dependent upon the profile of the edge 16 and various finishing steps that are optionally performed. For example, if the edge 16 is to bisect the axial line A, the stylus 12 is advanced until surface 34 intersects the axial line A. However, if a polishing step is to be performed, the advance of the stylus 12 may be stopped just prior to the surface 34 intersecting the axial line A. Upon removal of sufficient material from the stylus 12, the stylus 12 is rotated at step 94.

At step 94 the stylus 12 is rotated to generate the curvature or camber in the surface 34. For example, the indexing plate 48 and thus the stylus 12, is rotated such that the indexing pin 74 contacts one side of the slot 72 and then the other side of the slot 72. In addition, the steps 92 and 94 need not be performed in the order presented but rather, the steps 92 and 94 may be performed essentially simultaneously, alternating one then the other, or the like. Following the method 78 and generation of the edge 16 a variety of finishing and/or evaluation steps are optionally performed. For example, the surfaces 32 and/or 34 may be polished or ground with a relatively finer abrasive to remove burrs or wire-edge structures from the edge 16. In addition, the cutter 10 in general and edge 16 in particular are optionally inspected to determine if the edge 16 is adequate.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An ultrasonic blade for cutting at least one of a metal foil and a metal graphite composite, comprising:

a blade body defined about an axial line extending between a first side and a second side of the blade body;

a first surface being formed at a first angle relative to the axial line and having a first curve, the first surface extending continuously from the first side to the second side of the blade body;

a second surface being formed at a second angle relative to the axial line and having a second curve, the second surface extending continuously from the first side to the second side of the blade body; and a cutting edge on the blade body defined by the intersection of the first surface and the second surface, the first and second curved surfaces in combination with the first and second angles generating the cutting edge, the cutting edge comprising a first straight portion connected to a second straight portion via a curved portion, the first and second straight portions are angled with respect to each other and with respect to the axial line, wherein a profile of the cutting edge is substantially smooth and substantially facet free.

2. The ultrasonic blade according to claim 1, wherein the cutting edge is a substantially continuous profile spanning a width of the blade body.

3. The ultrasonic blade according to claim 1, wherein the first straight portion and second straight portion are angled back towards the blade body at about 30° relative to a line perpendicular from the axial line.

4. The ultrasonic blade according to claim 1, wherein the curved portion is defined by a radius of about 0.04 inches.

5. The ultrasonic blade according to claim 1, wherein the blade body is comprised of a metal.

6. The ultrasonic blade according to claim 5, wherein the blade body is comprised of a high speed steel.

7. The ultrasonic blade according to claim 5, wherein the blade body is comprised of a carbide steel.

8. The ultrasonic blade according to claim 1, wherein the first surface is curved about the first surface axis with a radius of about 0.171 inches.

9. The ultrasonic blade according to claim 1, wherein the second surface is curved about the second surface axis with a radius of about 0.171 inches.

10. An ultrasonic blade for cutting a titanium graphite composite, the ultrasonic blade comprising:

a blade body defined about an axial line extending between a first side and a second side of the blade body;

a first surface being formed at a first angle relative to the axial line and having a first curve, the first surface extending continuously from the first side to the second side of the blade body;

a second surface being formed at a second angle relative to the axial line and having a second curve, the second surface extending continuously from the first side to the second side of the blade body; and a cutting edge on the blade body defined by the intersection of the first surface and the second surface, the first and second curved surfaces in combination with the first and second angles generating a cutting edge, the cutting edge comprising a first straight portion connected to a second straight portion via a curved portion, the first and second straight portions are angled with respect to each other and with respect to the axial line at a relatively distal point of the blade body, wherein the ultrasonic blade is configured to receive ultrasonic vibrational energy to cut the titanium graphite composite, and wherein a profile of the cutting edge is substantially smooth and substantially facet free.

11. The ultrasonic blade according to claim 10, wherein the cutting edge is a substantially continuous profile spanning a width of the blade body.

12. The ultrasonic blade according to claim 10, wherein the first straight portion and second straight portion are angled back towards the blade body at about 30° relative to a line perpendicular from the axial line.

13. The ultrasonic blade according to claim 10, wherein the axial line, first surface axis and second surface axis substantially converge at a point.

14. The ultrasonic blade according to claim 10, wherein the curved portion is defined by a radius of about 0.04 inches.

15. The ultrasonic blade according to claim 10, wherein the blade body is comprised of a metal.

16. The ultrasonic blade according to claim 15, wherein the blade body is comprised of a high speed steel.

17. The ultrasonic blade according to claim 15, wherein the blade body is comprised of a carbide steel.

18. The ultrasonic blade according to claim 10, wherein the first surface is curved about the first surface axis with a radius of about 0.171 inches and the second surface is curved about the second surface axis with a radius of about 0.171 inches.

* * * * *

UNITED STATES PATENT AND TRADEMARK OFFICE

CERTIFICATE OF CORRECTION

PATENT NO. : 7,614,937 B2
APPLICATION NO. : 10/809698
DATED : November 10, 2009
INVENTOR(S) : Daniel L. Nydegger It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 496 days.

Signed and Sealed this

Nineteenth Day of October, 2010

David J. Kappos

David J. Kappos
*Director of the United States Patent and Trademark Office*